US005616255A

United States Patent [19]

Tumminaro, Jr.

[11] Patent Number: 5,616,255

[45] Date of Patent: Apr. 1, 1997

[54] SOLUTION AND PROCESS FOR CHEMICALLY RESHARPENING SMOOTHING TOOLS, FORMING TOOLS, AND CUTTING TOOLS

[76] Inventor: Anthony J. Tumminaro, Jr., R.R. 2, Box 177, Devils Lake, N. Dak. 58301-9802

[21] Appl. No.: 369,592

[22] Filed: Dec. 15, 1994

Related U.S. Application Data

[63] Continuation-in-part of Ser. No. 133,995, Oct. 12, 1993, Pat. No. 5,382,319.

[51] Int. Cl.[6] ..... B44C 1/22; C23F 1/00

[52] U.S. Cl. ..... 216/11; 216/91; 216/100; 252/79.2; 252/79.4

[58] Field of Search ..... 252/79.2, 79.4; 216/91, 100, 108, 11

[56] References Cited

U.S. PATENT DOCUMENTS

| | | | |
|---|---|---|---|
| 1,314,450 | 8/1919 | Whyte | 216/11 |
| 3,492,178 | 1/1970 | Westling | 252/79.2 X |
| 4,534,827 | 8/1985 | Henderson | 252/79.2 X |
| 5,382,319 | 1/1995 | Tumminaro | 252/79.2 |

FOREIGN PATENT DOCUMENTS

| | | | |
|---|---|---|---|
| 130272 | 7/1919 | United Kingdom | 216/11 |

*Primary Examiner*—William Powell
*Attorney, Agent, or Firm*—David A. Lingbeck

[57] ABSTRACT

A solution and process for chemically resharpening smoothing tools, forming tools, and cutting tools such as files, jigsaw blades, hacksaw blades, coping saw blades, bandsaw blades, and other tools. The solution contains preferred concentrations of acid and water. The tools are immersed in the solution for a period of from 1 minute to 12 hours depending upon the wear to the tools, the size of the tools, and the number of times the solution has been reused, at the end of which the tools are removed, wiped, and allowed to air dry so that rust resistant property in the solution adheres to the tools.

4 Claims, No Drawings

SOLUTION AND PROCESS FOR CHEMICALLY RESHARPENING SMOOTHING TOOLS, FORMING TOOLS, AND CUTTING TOOLS

BACKGROUND OF THE INVENTION

This invention relates to a solution and process for chemically sharpening smoothing tools, forming tools, and cutting tools, such as files and the like, which are made of metal and can be used to smooth, form, or cut wood, metal, plastic, laminate, and the like. The application being submitted here is a continuation-in-part patent application of patent application Ser. No. 08/133,995, filed Oct. 12, 1993, now U.S. Pat. No. 5,382,319.

Conventionally, there are a wide variety of solutions and processes for sharpening tools and blades. None of the prior art describes a solution and process for chemically resharpening files and the like as described in the present invention.

One known prior art is a BLADE SHARPENING SOLUTION AND PROCESS, U.S. Pat. No. 3,492,178, comprising an etching solution of essentially ten percent chromic acid, fifteen percent sulfuric acid, fifteen percent magnesium hydroxide, fifteen percent aluminum hydroxide, three percent calcium carbonate, two percent magnesium trisilicate, and thirty-four percent distilled water into which stainless steel razor blades are immersed and removed after a period of time and dried.

Another known prior art is a METHOD AND APPARATUS FOR RESHARPENING CUTTING TOOLS BY ELECTROPOLISHING PROCESS, U.S. Pat. No. 4,406,759, which comprises immersing the cutting tools in an electrolytic solution and DC voltage is applied between the tool, which serves as an anode, and a cathode plate immersed in the solution to thereby polish the edge of the tools by dissolution.

Another known prior art is a METHOD AND BATH FOR ELECTROCHEMICALLY RESHARPENING OF CUTTING TOOLS, U.S. Pat. No. 4,710,279, comprising an aqueous solution of phosphoric acid and sulfuric acid to which is added stabilizers of chromic acid, nickel carbonate and ferric oxide. An electrical potential is applied to the cutting tool within the bath within the range of one-half volt to six volts for a period of between one and twenty minutes.

Yet, another known prior art is a SOLUTION AND PROCESS FOR CHEMICALLY RESHARPENING SMOOTHING TOOLS, FORMING TOOLS, AND CUTTING TOOLS, application Ser. No. 08/133,995, invented by the applicant and filed on Oct. 12, 1993, U.S. Pat. No. 5,382,319.

None of the prior art describes or even suggests the present invention of resharpening forming tools and smoothing tools in addition to cutting tools using a solution of chemicals not described or suggested by any of the prior art. There is a definite need for a solution and process for chemically resharpening forming, smoothing, and cutting tools and the like.

SUMMARY OF THE INVENTION

The present invention relates to a solution and process for chemically resharpening forming, smoothing, and cutting tools and the like. The solution comprises preferably 45% chromic acid and 25% sulfuric acid and the balance of said solution being water, all of which is placed in a non-reactive tank. The tool should be completely immersed in the solution and should remain immersed in the solution for a period of preferably 1 minute to 12 hours depending upon the degree of wear and the types of teeth of the tool such as a file and the like. At the end of the recommended immersion period, the tool should be removed from the solution and wiped dry so that a rust resistant coating in the solution substantially adheres to the tool which may be a file, a router bit or drill bit, a saw, or other miscellaneous tool.

It is an object of the present invention to provide a solution and process for resharpening forming, smoothing, and cutting tools including files, which saves the user of such tools money not having to always buy new tools as such whenever the old tools become dull, the cost to resharpen used tools being in the range of 1/10 to 1/30 the cost of new tools.

Another object of the present invention is to provide a solution and process for resharpening forming, smoothing, and cutting tools which is safe for the user to use unlike the chemicals used in the prior art, which are known to be harmful to the blood, bone marrow, and kidneys as such of the user.

Also, another object of the present invention is to provide a solution and process for resharpening forming, smoothing, and cutting tools, which is environmentally safe to use.

Yet, another object of the present invention is to provide a solution and process for resharpening forming, smoothing, and cutting tools, which is simple to do and is relatively labor free.

Further objects and advantages of the present invention will become more apparent as the description proceeds.

DETAILED DESCRIPTION OF THE INVENTION

The present invention relates to a solution and process of chemically resharpening forming, smoothing, and cutting tools, such as files, saw blades of all kinds, router and drill bits and other tools capable of being sharpened. In a preferred embodiment, the solution should comprise 45% by volume of chromic acid, 25% by volume of sulfuric acid, and the balance being water, all thoroughly mixed together and placed in a non-reactive tank with the solution having a temperature of at least 35 degrees Fahrenheit and having a volume great enough so that the tool is completely immersed in the solution which acts upon and chemically resharpens the tool by evenly etching, carving, cutting and sharpening the cutting edge thereof. After the tool is allowed to set in the solution for a period of time, it should be removed from the solution, wiped and air dried. The once-dulled teeth or cutting edge of the tool will be substantially resharpened.

The solution, in addition to containing chemicals which resharpen tools such as files and the like, also can contain a rust inhibitor or inhibitors which coats the tool while immersed in the solution. This rust resistant property includes petroleum based products such as light oils, sprays or penetrating lubricants, acids or acid mixtures, and may even include a plating process. This rust resistant property coats the tool while immersed in the solution and adheres to the tool upon being removed from the solution, wiped and allowed to air dry. This rust resistant property substantially prevents oxidation of the tool.

The strength of the solution and the number of times the solution can be reused depends upon the concentration of the chemicals in the water. Heavier concentrations of chromic acid and sulfuric acid in the solution allows the user to reuse the solution more times for resharpening tools and also to use the solution to resharpen larger tools showing more wear such as lawn mower blades. For example, the solution can comprise 1% by volume of sulfuric acid or a combination of sulfuric acid and chromic acid with the balance being water, this solution being useful to resharpen smaller tools which are not that dull to begin with. On the other hand, the solution can comprise 99% by volume of sulfuric acid or combination of sulfuric acid and chromic acid with the balance being water, this solution being useful to resharpen the larger tools having teeth or blades which are quite dull.

In addition to increasing the concentrations of acid or acids to water in the solution, other chemicals or agents are available which can be added to the solution to enhance the whetting characteristics of the solution. Whetting agents or surface agents include phosphonic ester polymers, precipitated silica, hydrotopes, linier alkylbenzene sulfonates, sulfo ester, alkyl sulfate, sodium dodecylbenzene sulfonate, sodium lauryl sulfate, ethylene oxide propylene oxide polymers, and sodium sulfo methylethyl laurate, any of which can be added to the acid solution to enhance the resharpening characteristics of the solution which would preferably comprise under 1% by volume of the whetting agents but could comprise up to 10% by volume thereof. Other chemicals including other acids can also be added to the acid solution to accelerate the chemical activity of the acid solution thus effecting an accelerated resharpening process. The accelerating chemicals or accelerants include sulfuric acid, gluconic acid, chromic acid, chromic fluoride, and dodecelbenzenesulfonic acid, and the solution could comprise up to 25% by volume of the accelerants.

As an alternate embodiment, the resharpening solution may comprise from 1% to 99% by volume of sulfuric acid with the balance being water. In such a solution, the tool should be left in the solution for 1 to 60 minutes, then removed and allowed to dry. Again, the time variation for leaving the tools immersed in the solution is due to the amount of wear to the tool and to the number of times the solution has been reused and also to the size of the tool being resharpened.

As another alternate embodiment, the resharpening solution may comprise from 1% to 99% by volume of hydrochloric acid with the balance being water. The tool should be immersed in the solution for a period of 1 to 60 minutes depending upon the amount of wear to the tool and also depending upon how many times the solution has been reused, then removed, rinsed and wiped dry, and then dipped in a rust inhibitive solution, removed again, and allowed to dry again. Extreme caution should be exhibited when using hydrochloric acid and for that matter most any acids since they are known to be harmful to people should they come into direct contact with the acids, which is possible with this process since the user should completely immerse the tools in the solution and must remove the tools from the solution.

Further, as another alternate embodiment, the resharpening solution may comprise from 1% to 99% by volume of phosphoric acid with the balance being water. The tool should be immersed in this solution for a period of 1 to 6 hours, at the end of which the tool should be removed and wiped dry or allowed to dry.

The acid solutions and the immersion times for each solution are illustrated in the following tables:

TABLE 1

| (1 TO 60 MINUTES IMMERSION TIME) | |
|---|---|
| SOLUTION | % BY VOLUME |
| Chromic Acid | 45 |
| Sulfuric Acid | 25 |
| Water | 30 |

TABLE 2

| (1 TO 60 MINUTES IMMERSION TIME) | |
|---|---|
| SOLUTION | % BY VOLUME |
| Sulfuric Acid | 1–99 |
| Water | balance |

TABLE 3

| (1 TO 60 MINUTES IMMERSION TIME) | |
|---|---|
| SOLUTION | % BY VOLUME |
| Hydrochloric Acid | 1–99 |
| Water | balance |

TABLE 4

| (1 TO 6 HOURS IMMERSION TIME) | |
|---|---|
| SOLUTION | % BY VOLUME |
| Phosphoric Acid | 1–99 |
| Water | balance |

Various changes and departures may be made to the invention without departing from the spirit and scope thereof. Accordingly, it is not intended that the invention be limited to that specifically described in the specification or as illustrated in the tables but only as set forth in the claims.

What is claimed is:

1. A process for chemically resharpening forming tools, smoothing tools, and cutting tools which comprises the steps of:

providing a solution comprising 1% to 99% by volume of at least one acid and further introducing at least one whetting agent into said solution to enhance resharpening characteristics of said solution;

immersing a tool in said solution; and subsequently removing said tool from said solution.

2. A process for chemically resharpening forming tools, smoothing tools, and cutting tools as described in claim 1, wherein said solution includes up to 10% by volume of said at least one whetting agent which includes phosphonic ester polymers, precipitated silica, hydrotopes, linier alkylbenzene sulfonates, sulfo esters, alkyl sulfate, sodium dodecylbenzene sulfonate, sodium lauryl sulfate, ethylene oxide propylene oxide polymers, and sodium sulfo methylethyl laurate.

3. A process for chemically resharpening forming tools, smoothing tools, and cutting tools which comprises the steps of:

providing a solution comprising 1% to 99% by volume of at least one acid and further introducing at least one accelerant into said solution to substantially enhance said acid thus effecting improved resharpening characteristics of said solution;

immersing a tool in said solution; and subsequently removing said tool from said solution.

4. A process for chemically resharpening forming tools, smoothing tools, and cutting tools, as described in claim 3, wherein said solution includes up to 25% by volume of said at least one accelerant which includes sulfuric acid, gluconic acid, chromic acid, chromic fluoride, and dodecelbenzenesulfonic acid.

* * * * *